US006452477B1

(12) United States Patent
Roca et al.

(10) Patent No.: US 6,452,477 B1
(45) Date of Patent: Sep. 17, 2002

(54) HIGH VOLTAGE LOW INDUCTANCE CIRCUIT PROTECTION RESISTOR

(75) Inventors: Tony W. Roca, Franklin; John R. Anderson, South Milwaukee, both of WI (US)

(73) Assignee: Marconi Medical Systems, Inc., Cleveland, OH (US)

( * ) Notice: Subject to any disclaimer, the term of this patent is extended or adjusted under 35 U.S.C. 154(b) by 125 days.

(21) Appl. No.: 09/656,095

(22) Filed: Sep. 6, 2000

(51) Int. Cl.[7] ..... H01C 3/02

(52) U.S. Cl. ..... 338/61; 338/292; 338/293; 338/287; 338/297; 338/300; 338/261

(58) Field of Search ..... 338/254, 261, 338/278, 283, 286, 287, 288, 289, 293, 294, 297, 298, 300, 301, 61, 62, 63

(56) References Cited

U.S. PATENT DOCUMENTS

| | | | | | |
|---|---|---|---|---|---|
| 530,727 | A | * | 12/1894 | Shelton | 338/293 |
| 1,146,592 | A | * | 7/1915 | Northrup | 338/293 |
| 1,697,607 | A | * | 1/1929 | Maxson | 338/61 |
| 2,640,861 | A | * | 6/1953 | Kremers | 338/61 |
| 2,945,180 | A | * | 7/1960 | Parker | 338/293 |
| 4,568,907 | A | | 2/1986 | Hurtle | |
| 4,999,731 | A | | 3/1991 | Bender et al. | |
| 5,008,912 | A | | 4/1991 | Farrall et al. | |
| 5,053,743 | A | * | 10/1991 | Mille et al. | 338/297 |
| 5,107,187 | A | | 4/1992 | Miscikowski | |
| 5,132,999 | A | | 7/1992 | Wirth | |
| 5,229,743 | A | | 7/1993 | Miscikowski et al. | |
| 5,231,372 | A | | 7/1993 | Caddock, Jr. | |
| 5,347,571 | A | | 9/1994 | Furbee et al. | |
| 5,889,462 | A | * | 3/1999 | Rana et al. | 338/254 |
| 6,166,619 | A | * | 12/2000 | Baiatu et al. | 338/61 |

* cited by examiner

*Primary Examiner*—Karl D. Easthom
(74) *Attorney, Agent, or Firm*—Eugene E. Clair

(57) ABSTRACT

A high voltage low inductance resistor (120) includes a resistor body (122) having a perimeter and a center. A first terminal (126) is located away from the center of the resistor near the perimeter of the body (122). A serpentine resistance element (130) includes a first end (136). A conductive ring (124) is located near the perimeter and circumscribes the serpentine resistance element (130). The ring (124) is electrically connected to the first terminal (126). The first end (136) is electrically connected to the conductive ring (124). A first resistance segment (138*a*) of the resistance element (130) begins at the first end (136) and extends in a first direction generally around the perimeter of the body (122). An apex (142*a*) has an input portion (143) and an output portion (145). The apex (142*a*) redirects the resistance element in a generally opposite direction, the input portion (143) transitioning into the first resistance segment (138*a*). A second resistance segment (140*a*) exits the apex (142*a*) from the output portion (145) in a second direction generally opposite the direction of the first resistance segment (138*a*). The second resistance segment (140*a*) is located adjacent to and spaced apart from the first resistance segment (138*a*). The pattern of the interconnected first and second resistance segments is arranged to provide a concentric serpentine pattern in a single plane. A second end (148) of the resistance element (130) is located approximately at the center of the resistor element. A second terminal (128) is located at the center of the resistor (120) and is electrically connected to the second end (148) of the serpentine resistance element (130).

18 Claims, 7 Drawing Sheets

HIGH VOLTAGE LOW INDUCTANCE CIRCUIT PROTECTION RESISTOR

BACKGROUND

The present invention relates to high voltage low inductance resistors and is particularly related to a resistor used to regulate transient current flow caused by electrical discharge within high voltage electrical equipment. The present invention finds particular application in conjunction with high voltage vacuum tubes, particularly x-ray tubes, and will be described with respect thereto.

Conventional diagnostic use of x-radiation includes radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are digitally constructed from x-rays produced by a high powered x-ray tube rotated about a patient's body.

Typically, an x-ray tube includes an evacuated envelope made of metal, glass, ceramic materials or combinations thereof which is supported within an x-ray tube housing. The x-ray tube housing provides electrical connections to the envelope and is filled with a fluid such as oil to aid in cooling components housed within the envelope. The envelope and the x-ray tube housing each include an x-ray transmissive window aligned with one another such that x-rays produced within the envelope may be directed to a patient or subject under examination. In order to produce x-rays, the envelope houses a cathode assembly and an anode assembly.

The cathode assembly includes a cathode filament through which a heating current is passed. This current heats the filament sufficiently that a cloud of electrons is emitted, i.e. thermionic emission occurs. A high potential, on the order of 100–200 kV, is applied between the cathode assembly and the anode assembly. This potential causes the electrons to flow from the cathode assembly to the anode assembly through the evacuated region in the interior of the evacuated envelope. A cathode focusing cup housing the cathode filament focuses the electrons onto a small area or focal spot on a target of the anode assembly.

The electron beam impinges the target with sufficient energy that x-rays are generated. A portion of the x-rays generated pass through the x-ray transmissive windows of the envelope and x-ray tube housing to a beam limiting device, or collimator, attached to the x-ray tube housing. The beam limiting device regulates the size and shape of the x-ray beam directed toward a patient or subject under examination thereby allowing images to be constructed.

In order to distribute the thermal loading created during the production of x-rays a rotating anode assembly configuration has been adopted for many applications. In this configuration, the anode assembly is rotated about an axis such that the electron beam focused on a focal spot of the target impinges on a continuously rotating circular path about a peripheral edge of the target. Each portion along the circular path becomes heated to a very high temperature during the generation of x-rays and is cooled as it is rotated before returning to be struck again by the electron beam.

Typically, the anode assembly is mounted to a rotor which is rotated by an induction motor. The anode assembly and rotor are part of a rotating assembly which is supported by a bearing assembly.

During operation, the x-ray tube presents a high impedance of several hundred thousand ohms to the voltage applied between the anode assembly and cathode. This results in a relatively small current flow through the vacuum space between the anode assembly and cathode assembly. Under normal operating conditions, the power source is capable of regulating the current flow between the anode and cathode. Despite the regulation by the power source and the electrical isolation of the anode and cathode, when two elements with such a large difference in potential are placed proximate to each other, there is a tendency to arc. An arc is an undesired surge of electrical current between two elements which are at a different electrical potential.

In an x-ray tube, arcing can occur through residual gas molecules present within the evacuated envelope of the x-ray tube. As an x-ray tube ages, the tendency to arc often increases due to such factors as degradation of the vacuum within the tube resulting in increased gas pressure. The increased gas pressure within the evacuated envelope is due to the existence of additional undesired gas molecules. For example, gas molecules may migrate through the envelope, evolve from the materials within the envelope or are released as a result of damage to the components due to arcing. Consequently, the mean free path between gas molecules is reduced such that a chain reaction is more likely to occur when the gas molecules in the vacuum envelope are ionized by the high electric fields generated during normal tube operation. This chain reaction is called avalanche and is a form of arcing.

Arcing typically occurs in an area of the x-ray tube having the highest electric field strength. As such, arcing in an x-ray tube will commonly occur in the general region where the cathode is supplying the anode with electrons for the production of x-ray emissions. In addition, the structural imperfections of the electrodes contribute to the location where arcing occurs. This is because there are intense electric field gradients caused by contamination, sharp corners or rough edges on the surfaces of the electrodes. In particular, fields are higher where there are surface imperfections on the anode disk.

One consequence of arcing is the radiation and conductance of intense electrical noise on the high voltage electronic components. These noise emissions can cause failure of semiconductor devices in the system circuitry.

Another effect of arcing is the sputtering of metal from the cathode produced during arcing often lands on the internal surface of the glass envelope in proximity to the cathode. The existence of the metal deposits on the glass envelope can deleteriously effect x-ray tube performance for several reasons. First, as arcing occurs from time to time, sputtered metal deposits will continue to grow. As the sputtered metal deposits on the glass envelope gets too thick, an electrical charge may accumulate sufficient to damage the glass envelope thereby rendering the tube nonfunctional. Secondly, sputtered metal deposits on the glass envelope will often attract arcing between the deposits and the cathode. The surges of electrical current produced during arcing can damage the glass envelope, again rendering the tube nonfunctional.

When the x-ray tube arcs, a current on the order of hundreds of amperes can flow between the cathode and the anode. Once an x-ray tube starts to arc, an avalanche type effect may occur sputtering metal and the metal atoms as well as ionizing the contaminants in the vacuum. These events further contribute to yet more frequent arcing. In addition, arcing in an x-ray tube used in a Computed Tomography (CT) imaging system contaminates the x-ray signal collected at the detectors and affects proper image reconstruction. This may result in an un-usable set of data requiring another CT scan of the patient.

As mentioned above, arcing can shorten the useable service life of the x-ray tube. Given the considerable cost of an x-ray tube and the associated service costs for replacement, it is desirable to extend the service life of the x-ray tube.

One known method to extend service life and reduce arcing involves providing getter material inside the glass envelope to help maintain the evacuated state. The getter material binds gases on its surface and absorbs such gases to maintain the vacuum state in the x-ray tube. The process of removing residual gases from an evacuated area by binding and absorbing is known as pumping. By using getter material to maintain a vacuum state, arcing is reduced since there is a reduction in the number of gas molecules through which large current surges may flow. Unfortunately, as the x-ray tube ages the effectiveness of the getter material in pumping also diminishes. As a result, arcing tends to become more frequent as the getter is used and the tube ages.

Information relevant to other attempts to address the problem of transient current surges during arcing can be found in U.S. Pat. Nos.: 5,229,743; 5,107,187; 5,132,999 and 5,008,912. However, each of these references suffers from one or more of the following disadvantages: (i) the transient control apparatus is too large to be located near enough to the anode terminal of the x-ray tube, (ii) mechanical failure of the device from limiting the damaging current flow, (iii) difficult and costly to manufacture (iv) inconsistent electrical characteristics such as inductance, voltage drop etc. (v) low reliability and (vi) lower surge load capacity.

Referring to FIGS. 1, 2 and 3, a prior art low inductance resistor 80 is shown that is used in an x-ray system 20 as a resistor 76. The resistor 80 is circular and has a diameter slightly larger than the outside diameter of a socket member (not shown) for receiving and electrically connecting an anode end 81 of an x-ray tube 24 to a power supply 22. The resistor 80 includes a conductive cylindrical high voltage terminal 82 having a threaded inner surface for receiving a mounting bolt (not shown). The mounting bolt secures a terminal (not shown) connected to a high voltage conductor 74 to electrically connect the resistor 80 to the power supply 22. An electrically conductive annular hub 86 is located at the center of the resistor 80. Both the high voltage terminal 82 and the annular hub 86 serve as electrical terminals to electrically connect the resistor 80 between the conductor 74 and an anode end 81 of the x-ray tube 24. The annular hub 86 includes a bore 88 for allowing passage of a threaded bolt (not shown) that is threadably received in a bore (not shown) in the anode end 81 of the x-ray tube 24 to secure the resistor and complete the electrical connection of the resistor 80 in the circuit. A body 90 of the resistor 80 is formed from an electrically non-conductive resin and is hardened with a hardener and vacuum molded. A barrier 98 of non-conductive body material is located between the terminal 82 and hub 86.

The terminal 82 is electrically connected to a ring 100 of conductive material having a diameter slightly less the diameter of the resistor 80. The conductive ring 100 is split at one point and the ends are suitably attached to the conductive terminal 82 such that an appropriate electrical connection is completed for use at the anticipated operating and arcing conditions experienced by the x-ray tube. The electrical resistance of the resistor 80 is provided by two spirally wound coils of resistance wire 94 and 96. The wires 94, 96 are electrically connected at one end to the hub 88 at a point 102 and at the other end to conductive ring 100 at a point 104. The two spirals of resistance wire 94, 96 are counter wound and laid out in parallel planes within the resistor 80. When energized, the current in each wound spiral of wire flows in the respective directions of arrows 106 and 108. Each spiral consists of approximately of 60 turns of wire. The resistance wire coils 94, 96 are connected in electrical parallel between the ring 100 and the hub 86. Referring to FIG. 3, the wire coils 94, 96 are spaced apart and electrically isolated from one another with a layer 110 of the electrically non-conductive resin.

In prior art multi-planar resistor devices, the distances between the two spiral wound resistive elements can vary. This can result in varying the distances between the magnetic fields generated in each of the spiral wound resistor wires 94, 96 as well as the uniformity of the resulting magnetic fields across the planar surfaces of the resistor. In addition, interaction between the magnetic fields of the spiral wound wire coils during higher current and fault conditions generate forces on the coils and other components of the resistor that result in mechanical and/or electrical failure of the resistor. Irregularities in the magnetic fields due to variation in coil spacing may cause localized in-homogeneity resulting in failure. Such a failure in an operating x-ray system requires an expensive repair before the system is returned to specified operating parameters.

For the foregoing reasons, there is a need for an apparatus for the reduction of arcing and associated current surges in x-ray tubes that is more easily manufactured, has more consistent electrical characteristics and has improved durability.

SUMMARY OF THE INVENTION

The present invention is directed to a low inductance resistor that satisfies the needs described above. An apparatus in accordance with one embodiment of the present invention includes a resistor body that has a perimeter and a center. A first terminal is located away from the center of the resistor near the perimeter. A serpentine resistance element has a first end and a first resistance segment which begins at the first end. The first resistance segment extends in a first direction generally around the perimeter of the body, e.g. in a clockwise direction. The resistance element includes a generally "U" shaped apex having an input side and an output side. The first resistance segment transitions into the input side. The resistance element includes a second resistance segment that exits the apex from the output side in a second direction generally opposite that of the first resistance segment, e.g. counterclockwise. The second resistance segment is located adjacent to, and spaced apart from, the first resistance segment. The pattern formed by the first and second resistance segments provides a concentric serpentine pattern located in a single plane. The resistance element includes second end located approximately at the center of the resistor element. A conducive ring circumscribes the serpentine resistance element. The ring is electrically connected to each of the first terminal and the first end of the serpentine resistance element. A second terminal is located at the center of the resistor and is electrically connected to the second end of the serpentine resistance element.

In accordance with a more limited aspect of the present invention, the electric current in the adjacent first and second resistance segments flows in a generally opposite direction. In another aspect of the invention, the second resistance segment is shorter in length than the first.

In accordance with another limited aspect of the invention, the resistor element includes a plurality of additional adjacent concentric spaced apart resistance segments and interconnecting apexes. The plurality of resistance segments and apexes are located in a single plane and are interconnected between the second resistance segment and the second terminal such that a continuous serpentine resistance element extends from the first terminal to the second terminal at the center of the resistor.

One feature of a resistor in accord with the principles of the present invention is that for a pair of resistance segments, the length of the resistance segment located nearer the center of the resistor is shorter than the length of resistance segment located further from the center of the resistor.

In accordance with a yet more limited aspect of the present invention, the first and second resistance elements are generally circular.

In accordance with another aspect of the present invention, the distance between adjacent concentric resistance sections at the perimeter of the resistor body is greater than the distance between adjacent concentric resistance sections near the center of the resistor.

Yet another aspect of the present invention, the apexes joining the adjacent concentric resistance sections lie adjacent a radial line extending from the center of the resistor.

In accordance with another aspect of the present invention, the single plane serpentine resistor is electrically connected to the corona ring and the second terminal. The plurality of concentric adjacent spaced apart resistance segments are connected by apexes. The value of the difference in electrical potential between adjacent apexes near the center of the resistor is less than the value of the difference in electrical potential between adjacent apexes near the perimeter of the resistor. In accordance with a more limited aspect of the invention, the change in value of the difference in electrical potential between adjacent apexes is non-linear when sequentially comparing the voltage difference between apexes from the resistor perimeter to the voltage difference between apexes near the resistor center.

In accordance with another aspect of the invention, an apparatus for an x-ray tube utilizes the resistor of the present invention. The x-ray tube includes a cathode assembly, an anode assembly, a bearing assembly rotatably supporting the anode assembly, and an envelope enclosing the anode assembly, the bearing assembly and the cathode assembly in a vacuum. A low inductance resistor is included which has a body. A first terminal is located away from the center of the resistor. A corona ring within the body is electrically connected to the first terminal. A second terminal is located at the center of the resistor and is electrically connected to the bearing assembly. The low inductance resistor includes a serpentine resistance element having a first end and a second end. The first end is electrically connected to the corona ring. The resistance element extends in a plurality of adjacent concentric resistance sections located in a single plane. The adjacent resistance sections reverse direction at apexes joining the adjacent concentric resistance sections. Each adjacent concentric resistance section carrying electric current in an opposite direction than the electric current in the next adjacent concentric resistance section. The second end is electrically connected to the second terminal.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein.

DETAILED DESCRIPTION

Figure 1:
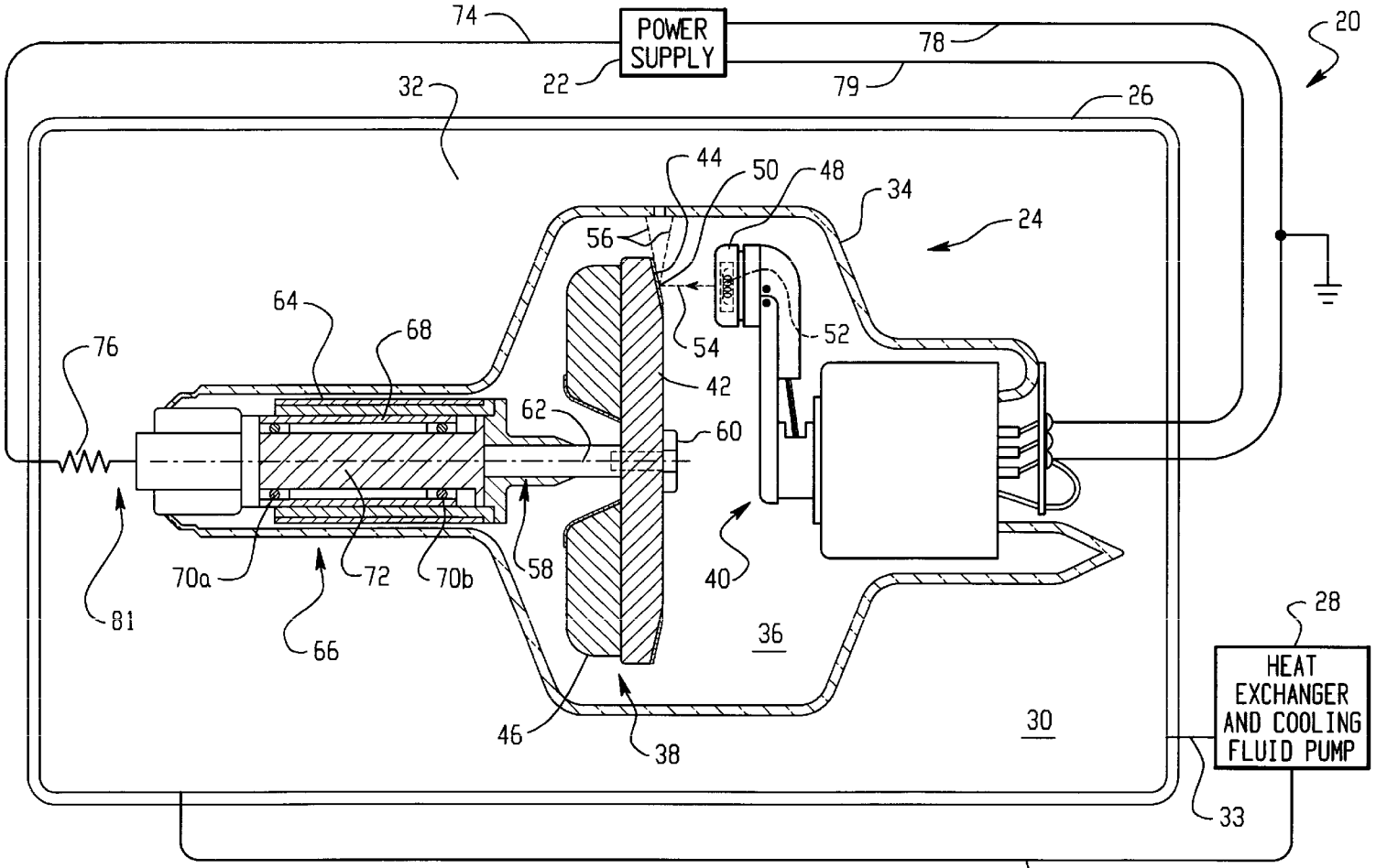
Fig. 1 PRIOR ART
FIG. 1 is a partial sectional schematic representation of a prior art x-ray system having a prior art arc reduction resistor.
Figure 3:
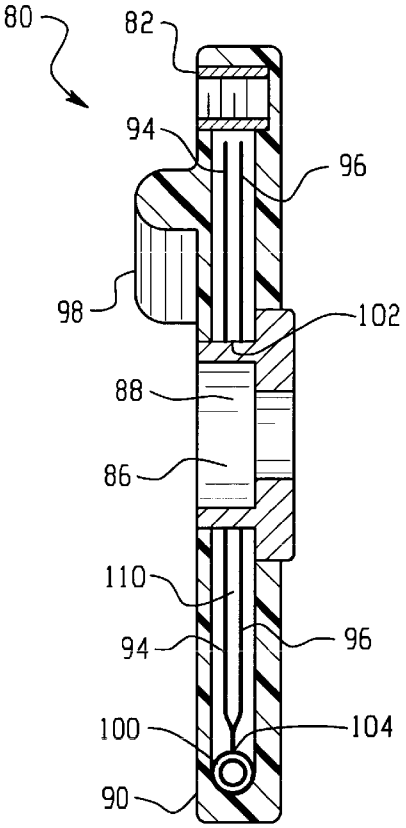
Fig. 3 PRIOR ART
FIG. 3 is a sectional view of the resistor of FIG. 2 along the line 3—3.
Figure 2:
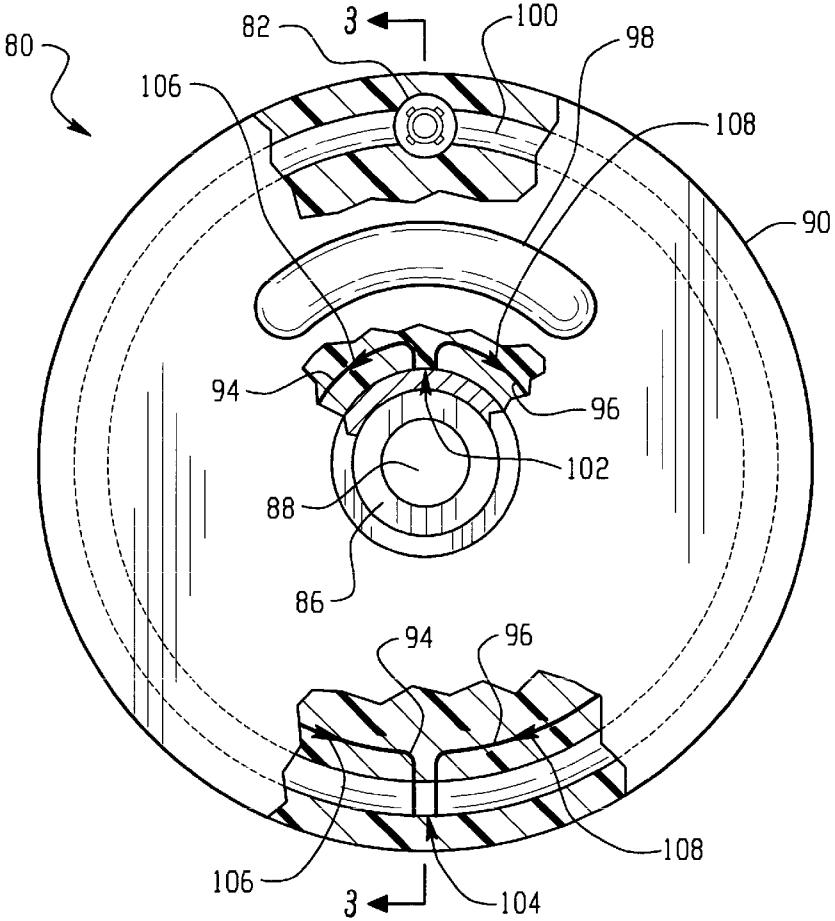
Fig. 2 PRIOR ART
FIG. 2 is a schematic partial sectional top plan view of a prior art resistor used in the system of FIG. 1.

With reference to FIG. 1, a schematic representations of an x-ray producing system 20 is shown. It is to be appreciated that the x-ray system 20 may be one that employs any of the conventional diagnostic or industrial uses of x-radiation including but not limited to (i) radiography, in which a still shadow image of a patient is produced on x-ray film, (ii) fluoroscopy, in which a visible real time shadow light image is produced by low intensity x-rays impinging on a fluorescent screen after passing through the patient, (iii) computed tomography (CT) in which complete patient images are digitally constructed from x-rays produced by a high powered x-ray tube rotated about a patient's body, (iv) industrial inspection and (v) security systems.

The system 20 includes a high voltage power supply 22, an x-ray tube 24 mounted within a housing 26 and a heat exchanger 28. The x-ray tube 24 is securely mounted with tube supports (not shown) in a conventional manner within the x-ray tube housing 26. The housing 26 is filled with a cooling fluid 30, for example diala oil, however it will be appreciated that other suitable cooling fluid/medium, such as air, could alternatively be used. The oil 30 is pumped through a supply line 31 into a chamber 32, defined by the x-ray tube housing 26, which surrounds the x-ray tube 24. The pumped oil 30 absorbs heat from the x-ray tube 24 and exits the housing 26 through a line 34 connected to the heat exchanger 28 disposed outside the x-ray tube housing 26. The heat exchanger 28 includes the cooling fluid pump.

The x-ray tube 24 includes an envelope 34 defining an evacuated chamber or vacuum 36. In the preferred embodiment, the envelope 34 is made of glass although other suitable material including other ceramics or metals could also be used. Disposed within the envelope 34 is an anode assembly 38 and a cathode assembly 40. The anode assembly 38 includes a circular target substrate 42 having a focal track 44 along a peripheral edge of the target 42. The focal track 44 is comprised of a tungsten alloy or other suitable material capable of producing x-rays when bombarded with electrons. The anode assembly 38 further includes a back plate 46 made of graphite to aid in cooling the target 42.

The cathode assembly 40 is stationary in nature and includes a cathode focusing cup 48 positioned in a spaced relationship with respect to the focal track 44 for focusing electrons to a focal spot 50 on the focal track 44. A cathode filament 52 (shown in phantom) mounted to the cathode focusing cup 48 is energized to emit electrons 54 which are accelerated to the focal spot 50 to produce x-rays 56.

The anode assembly 38 is mounted to a rotor stem 58 using securing nut 60 and is rotated about an axis of rotation 62 during operation. The rotor stem 58 is connected to a rotor body 64 which is rotated about the axis 62 by an electrical stator (not shown). The rotor body 64 houses a bearing assembly 66 which provides support thereto. The bearing assembly 66 includes a bearing housing 68, ball bearings 70*a*, 70*b*, and a bearing shaft 72. The bearing shaft 72 is coupled to the rotor body 64 and rotatably supports the anode assembly 38.

The power supply 22 provides high voltage of 70 kV to 100 kV to the anode assembly 38 through a high voltage conductor 74 and a resistor 76 that is located within the cooling fluid filled housing 26. The cathode assembly 40 is electrically connected to the power supply 22 with conductors 78, 79.

During operation of an x-ray system 20 in the generation of x-rays, the x-ray tube 24 has an impedance of several hundred thousand ohms showing across the anode assembly 38 and cathode assembly 40. However, during arcing the impedance of the x-ray tube drops significantly and an energy surge travels through the internal components of the x-ray tube. This high energy surge can damage the x-ray tube and shorten its useful life. It is known that the harmful effects of the energy surge can be reduced by providing the resistor 76 in series with the high voltage connection to the anode assembly 38. It has been found that a suitable resistance value for this purpose is approximately equal the combined resistance of the power supply 22 and high voltage cables 74, 78, in this example 84 ohms.

In the present invention, a new and different structure of the resistor provides for an arrangement that more precisely controls the inductance, simplifies manufacture and improves reliability of the resistor. Specifically, an etched single plane electrically resistive element replaces the plurality of spiral wound wires located in adjacent parallel planes. The single plane element allows greater epoxy thickness for higher dielectric strength while maintaining the same external dimensions. In addition, the new component provides for more precise placement of the electrically resistive element within the body of the resistor and improved manufacturability. The single plane, single path resistive element results in more constant inductive values than the prior art multi-planar devices.

Figure 4:
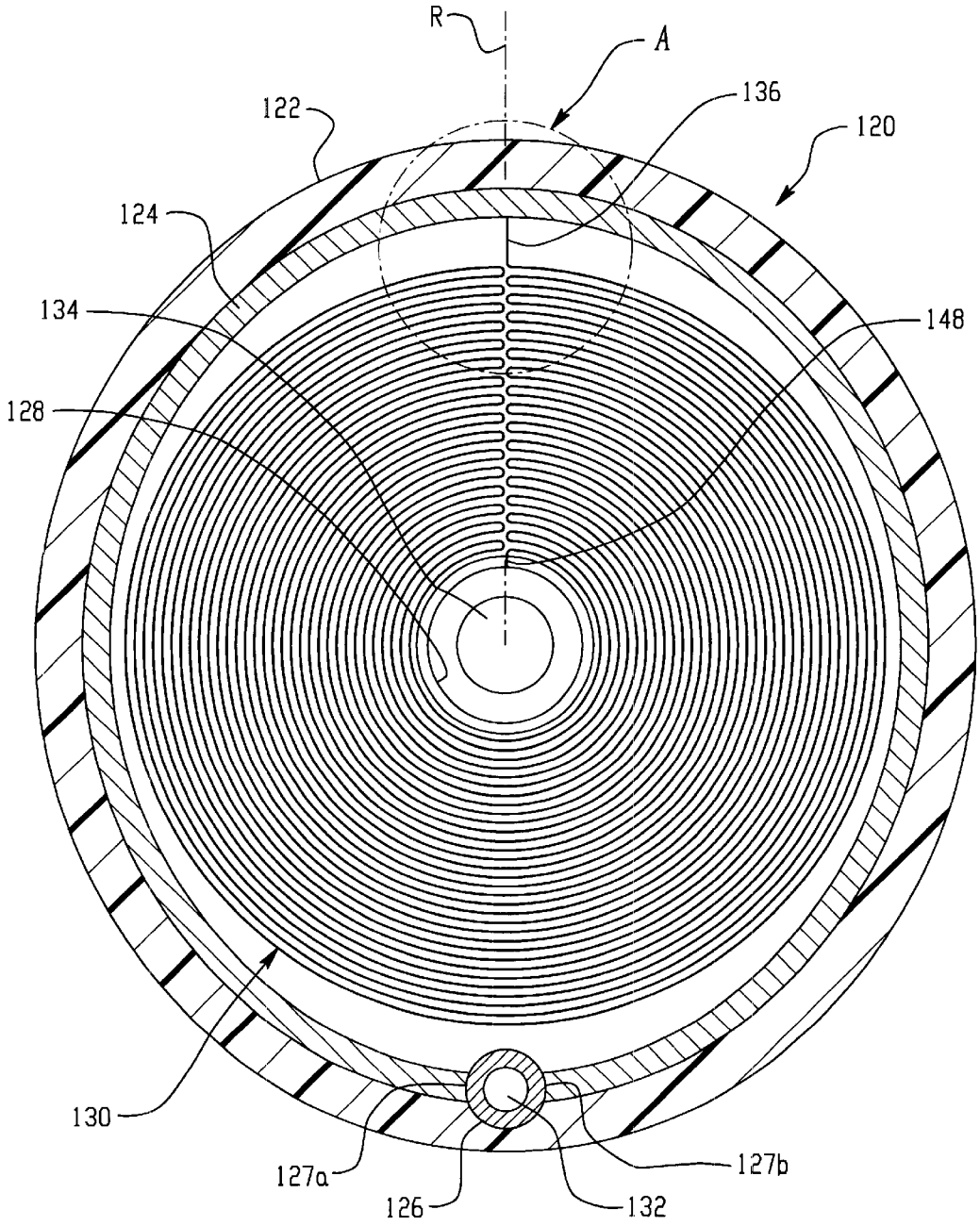
FIG. 4 is a top sectional view of a resistor showing features of the present invention.
Figure 5:
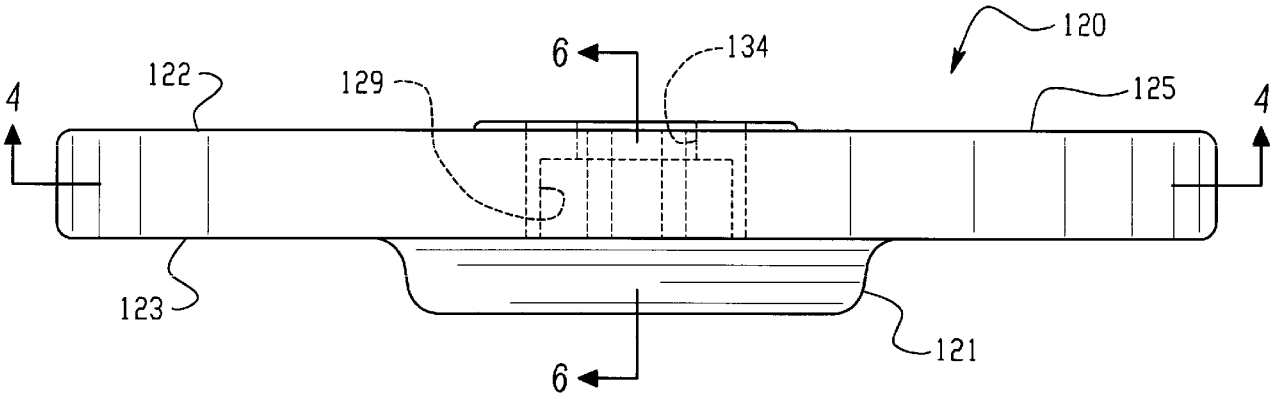
FIG. 5 is a side planar view of the resistor of FIG. 4 showing features of the present invention.
Figure 6:
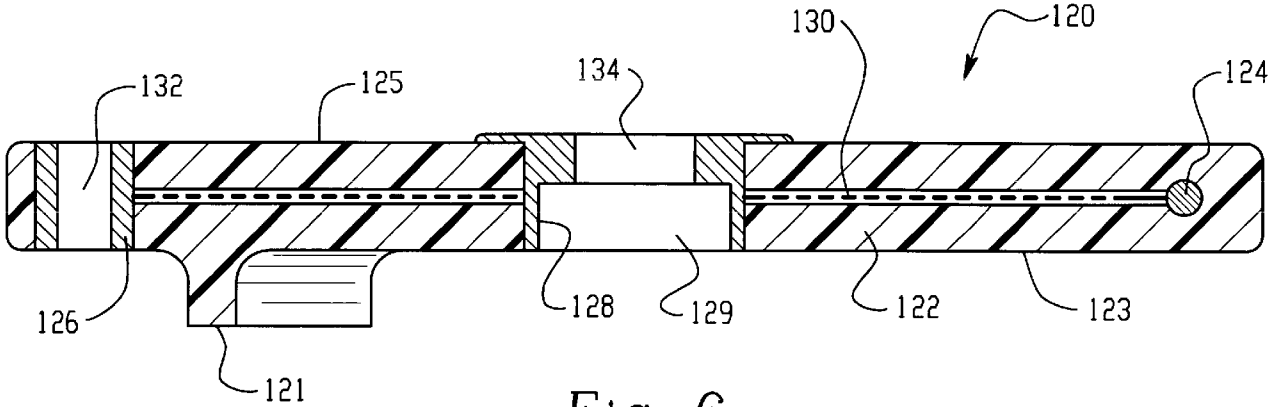
FIG. 6 is a side sectional view of the resistor of FIG. 4 showing features of the present invention.

Referring now to FIGS. 4, 5 and 6, a preferred embodiment of a resistor employing features of the present invention is shown. A resistor 120 includes a body 122, a corona ring 124, a high voltage terminal 126, a hub terminal 128 and a serpentine resistor element 130.

The serpentine resistance element 130 has a first end 136 that is electrically connected to the corona ring 124. The resistance element 130 is made from a suitable material such as titanium alloy. In the preferred embodiment, the alloy is 8-1-1 Titanium alloy provided in 0.015 flat sheets from Supra Alloy's, 351 Carter Circle, Camarillo Calif. 93012. Preferably, the pattern of the serpentine resistor element 130 is manufactured by a photo etching process for removal of material to form the resistance segments, apexes and gaps further described in detail below by chemical action.

Figure 7:
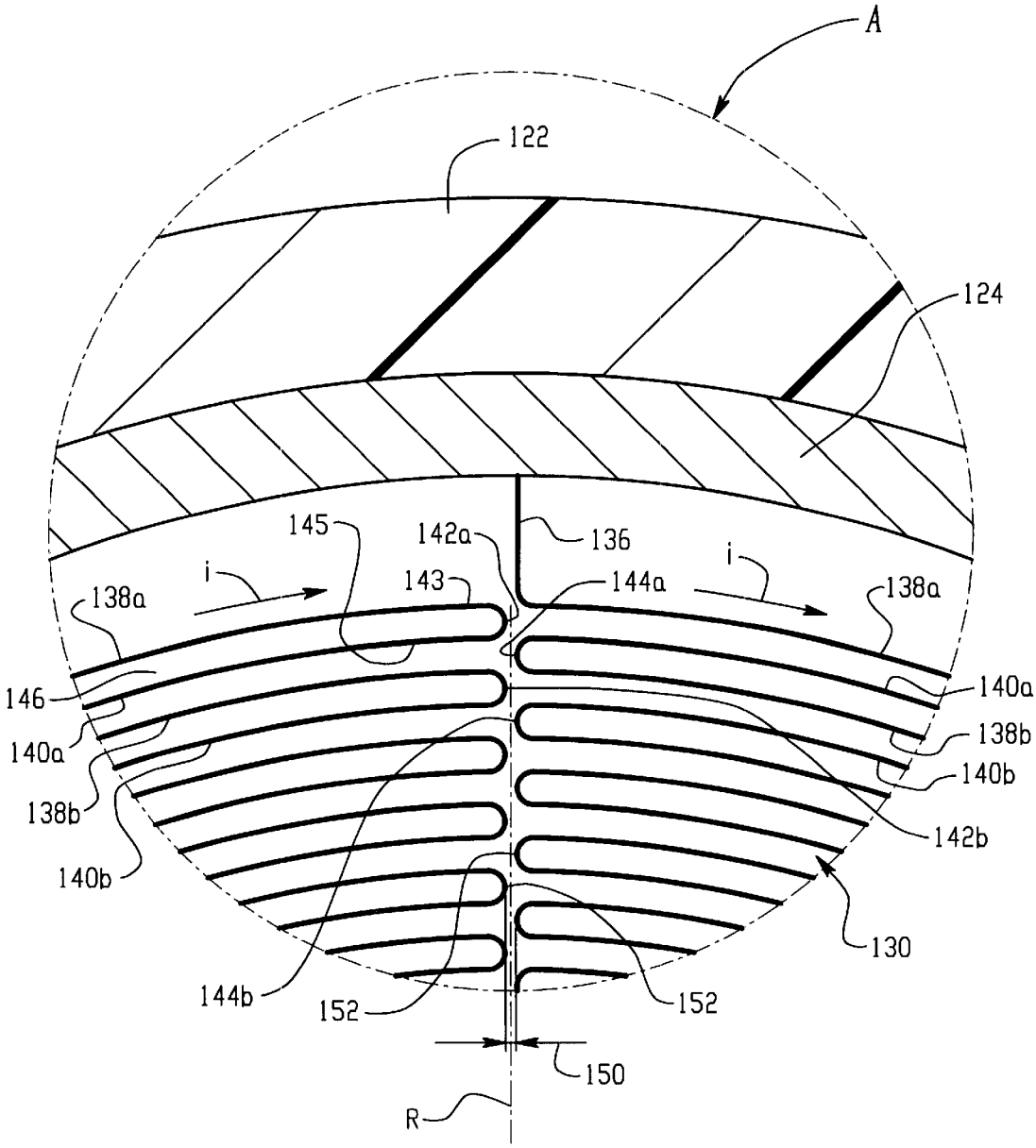
FIG. 7 is an enlarged top sectional view of a portion of the resistor of FIG. 4 shown in the area A.

Turning to FIG. 7, the first end 136 of the resistance element 130 proceeds toward the center of the resistor 120 to a plurality of generally circular resistance segments 138*a*–138(*a*+n) extending in a "clockwise" direction around the resistor and a plurality of associated circular resistance segments 140*a*–140(*a*+n) extending in a "counter clockwise" direction. Each adjacent resistance segment 138, 140 is concentrically located in an alternating, clockwise then counterclockwise, spaced apart relationship. Progressing from the perimeter of the resistance element 130 toward the center, each next adjacent segment is located at a smaller radius from the center of the resistor and has a shorter resistance segment length.

One associated pair of ends of the clockwise 138 and counterclockwise 140 resistance segments are joined at a first plurality of apexes 142*a*–142(*a*+n) which reverses the direction of the resistance element. The other associated pair of ends of the respective resistive segments are joined at a second plurality of apexes 144*a*–144(*a*+n) which connects the associated adjacent clockwise and counterclockwise resistance segments, again reversing the direction of the resistance element. The apexes 142 and 144 lie generally adjacent to a radial line "R" shown in FIG. 4. It is to be appreciated that the designations "a" and "a+n" indicating the number of associated resistance segments and apexes is to simplify the description and is not meant to indicate a limiting numerical relationship or ratio between any particular set of apexes or resistance segments. In this embodiment, the gaps between adjacent resistance segments is approximately 0.015"; titanium wire/resistor diameter/thickness/width is approximately 0.012"; and the space between the rows of apexes is approximately 0.060".

FIG. 7 shows the enlarged portion "A" of FIG. 4, for a more detailed description of the relationship and connections of the plurality of resistance segments 138, 140 and apexes 142, 144. It is to be appreciated that the "clockwise" and "counterclockwise" designations are used to differentiate adjacent concentrically located resistance segments having opposite flowing electrical current when the resistor is in an energized circuit. All of the clockwise and counterclockwise resistance segments are located in the same single plane. The clockwise segment 138*a* extends around the circular perimeter portion of the resistor 130 at the furthest diameter within the corona ring 124. This segment 138*a* has the greatest circumferential length. As the segment 138*a* nears completion of its circular path it joins with the counterclockwise segment 140*a* at the apex 142*a*. The segment 138*a* transitions into an input portion 143 of the apex 142*a*. Upon making the "U" turn at the apex 142*a*, the segment 140*a* begins its counterclockwise path at an output portion 145 of the apex 142*a*. The segment 140*a* is separated from the adjacent segment 138*a* by a gap 146 of approximately 0.015" in this example. When the resistance element 130 is retained in the body 122, the gap 146 is filled with the electrically non-conducting material that form the body of the resistor. The size of the gap 146 is selected to provide suitable insulation of the resistance segments under anticipated electrical conditions. The apexes 142 are separated from the apexes 144 by a space 150 which lies along the radial line "R." In this example. The space 150 is approximately 0.060". In addition, each apex has a peak 152 and the respective peaks of the apexes 142 are offset to be positioned opposite the respective gap between the peaks of the apexes 144. Consequently, the respective peaks 152 of the apexes 144 are offset to lie opposite the gaps between the apexes 142.

The counterclockwise extending resistance segment 140*a* is concentrically located at a radius that is less than that of the clockwise segment 138*a*. As the resistance segment 140*a* nears completion of its circular path it joins with the next internally adjacent clockwise resistance segment 138*b* at the apex 144*a*. The circumferential length, and consequently the resistance, of the counterclockwise segment 140*a* is less than that of clockwise segment 138*a*. Thus, there is less voltage drop along this segment 140*a* than in the segment 138*a*. The pattern of alternating clockwise segments 138 and counterclockwise segments 140 in shorter circumferential concentrically located segments continues until the resistance element 130 reaches a second end 148 which is electrically connected to the hub 128. The total number of alternating resistance segments is provided as necessary to obtain the desired electrical characteristics for a desired application.

During normal operation, and under arcing conditions, the current flowing through each adjacent resistance segment interacts to reduce magnetic fields generated by current flow in the next adjacent resistance segments. This reduction of magnetic fields due to the opposite current flow in the adjacent resistance segments results in a lower inductance resistor.

In addition, there is a decrease in the voltage drop in each progressively circumferentially smaller resistance segment 138, 140. Thus, the value of the difference in electrical potential between the respective apexes 142(*a*+n) and 144 (*a*+n) is less than the value of the difference in electrical potential between apexes 142*a* and 144*a*. As the voltage difference decreases, the dimensions for the space 150 and gaps 146 for the innermost segments of the resistor can be different than those at the outermost segments while maintaining adequate electrical isolation between the adjacent resistance segments and electrical components. In other words, as the voltage difference between adjacent components is decreased, the components may be located closer to one another. This permits a reduction in the physical size of the resistor since smaller spaces and gaps can be used for part of the resistor. In addition, the adjacent concentric resistance segments may be configured such that the variation in voltage difference between apexes along the line "R" varies in a non-linear manner when sequentially measured from the perimeter of the resistor to the center of the resistor as well as a non-linear variation along the length of the radial line "R" from the center to the perimeter of the resistor, The serpentine resistance element 130 is encapsulated in a thin film of clear, electrically non-conductive, ultra-violet cured material. The material separates and electrically isolates the resistor element segments and physically stabilizes the resistor for handling and placement during assembly and molding operations. A suitable encapsulant for the element is available as Dymax 628-ULV UV Light Curing Coating form Dymax Corporation, 51 Greenwoods Rd., Torrington, Conn. 06790.

In one example of a resistor suitable for use with an x-ray tube, the resistor 120 has the following specifications: 84 Joules, 84 ohm ±5%, 15 watts, 150 watts continuous, transients of 1500 amps for at least 0.5 microsecond, inductance less than 7.7 pH, 70 kV and able to allow 1 kJ to pass through. In this example, the resistor has a 3⅛" outside diameter, 0.29" thick from the first surface 123 to the second surface 125, the bore 134 in the hub 128 is 0.39" and the diameter of the wire used for the corona ring 100 is 0.09."

The body 122 is comprised of an electrically non-conductive two-part room temperature cured material that encapsulates, physically separates and electrically insulates the conductive elements of the resistor 120 from external structures and other resistor components as required. A suitable encapsulant for the body is available as Bonstone 5040 Encapsulant from Bonstone Material Corporation, 708 Swan Drive, Mukwonago, Wis. 53149. The material selected for the body also provides protection from heat generated by the operation of the x-ray tube and the cooling fluid within the housing. The body 122 is molded and shaped to suitably insulate the electrically conductive elements of the resistor while still exposing necessary conductive surfaces of the high voltage terminal 126 and hub 128 for external electrical connections. In the preferred embodiment, the body 122 is disk shaped and has a first surface 123 and a second surface 125 spaced apart from one another and lying in generally parallel planes. The body includes an arc barrier 121 molded of the non-conductive epoxy and extending away from the first surface 123. The arc barrier 121 is located between the high voltage terminal 126 and hub terminal 128.

In this example, the corona ring 124 is made of 0.090" diameter of electrically conductive material such as bare electrical copper wire. The corona ring 124 is circular and has a major diameter slightly less than the diameter of the disk shaped body 122 while circumscribing the serpentine resistance element 130. The ring 124 is located within the body 122 of the resistor 120 and is positioned at an appropriate distance from the perimeter of the non-conducting body 122 to provide sufficient electrical insulation of the ring from objects external to the resistor. The corona ring 124 is split at one point to provide two ring ends 127*a*, 127*b* for electrically conductive attachment of the ring 124 to surfaces of the high voltage terminal 126. For example, each end of the ring 124 is soldered to the terminal 126.

The high voltage terminal 126 is generally cylindrical and is made from an electrically conductive material. The major axis of the terminal 126 extends through the body 122 of the resistor 120 from the first surface 123 to the second surface 125 to expose both ends of the terminal 126 for proper electrical connection to an external electrical system to either exposed end. The terminal includes a bore 132 for receiving a bolt (not shown) for use in connecting the resistor 120 to the external electrical system.

The hub terminal 128 is located at the center of the disk shaped resistor 120 and its major axis extends through the resistor body 122 from the first surface 123 to the second surface 125. The hub 128 is made of conductive material and has a centrally located bore 134 for allowing a connecting bolt (not shown) to pass through and electrically connect the resistor 120 to the x-ray tube. Both ends of the hub 128 have exposed surfaces to facilitate proper electrical connection. The hub 128 includes a countersunk portion 140 for receiving the head of the connecting bolt to reduce the profile of the attached resistor when mounted to the anode end 81 x-ray tube 24 (see FIG. 1).

Figure 8:
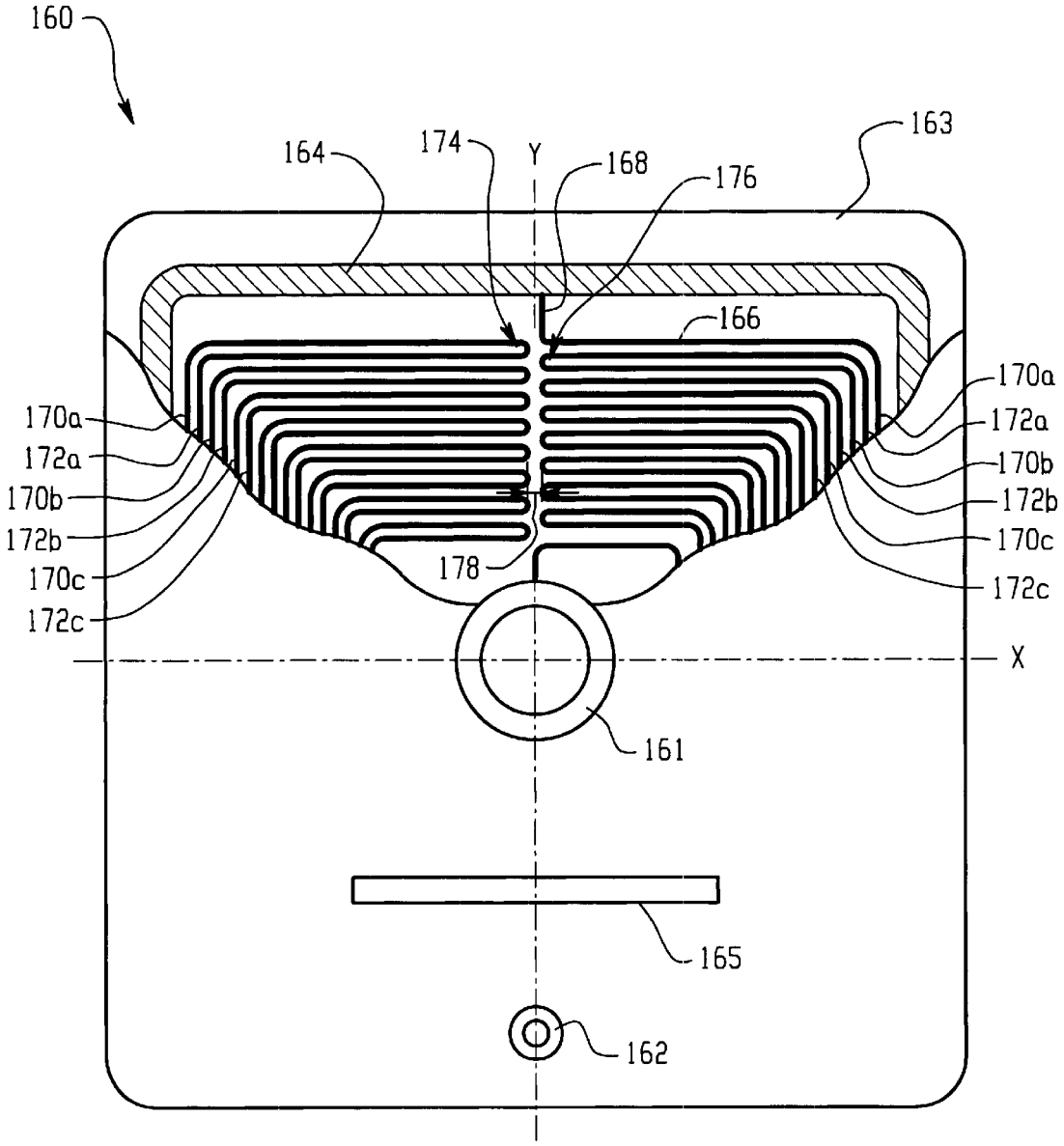
FIG. 8 is a partial sectional top view of another embodiment of a resistor showing features of the present invention.

In FIG. 8 another embodiment of a resistor 160 employing features of the present invention is shown. The resistor 160 has a rectangular shape with a hub terminal 161 approximately at its center. A high voltage terminal 162 is located near the outer perimeter of the resistor 160 and is electrically connected to a corona element 164 located near the outer perimeter of the resistor 160. A body 163 of the resistor 160 is comprised of an electrically non-conducting epoxy as described above and includes a barrier 165 between the terminal 162 and hub 161. A serpentine resistance element 166 is configured with clockwise resistance segments 170*a*–170(*a*+n), counterclockwise resistance segments 172*a*–172(*a*+n), a first plurality of apexes 174*a*–174(*a*+n) and a second plurality of apexes 176*a*–176(*a*+n). The first plurality of apexes 174 and second plurality of apexes 176 are separated by a gap 178 and offset from the opposite apexes as set forth above. The primary difference in this embodiment shown in FIG. 8 is that the serpentine resistance element 166 is rectangular in shape and the linear segments along the respective sides of the rectangle which form the alternating clockwise 170 and counterclockwise 172 resistance segments are concentrically located at progressively decreasing distances along the respective x and y axis rather than being concentric circular segments. In other words, when progressing from the outermost perimeter of the resistor each progressively shorter resistor segment, as measured form apex to apex, is concentrically located and "nested within" the next outer adjacent resistor segment. All of the resistor segments are located in the same plane. The size of the respective gap 178 between each adjacent segment and spaces between the apexes are selected such that when filled with the non-conducting body material it is sufficiently insulated. As the potential difference between the adjacent resistance segments decreases due to the reduced voltage drop, the gap and spaces vary. The operation of this embodiment of the resistor and the principle of reduction of magnetic fields by adjacent resistance segments having opposite current flow are is similar to the resistor described above.

Figure 9:
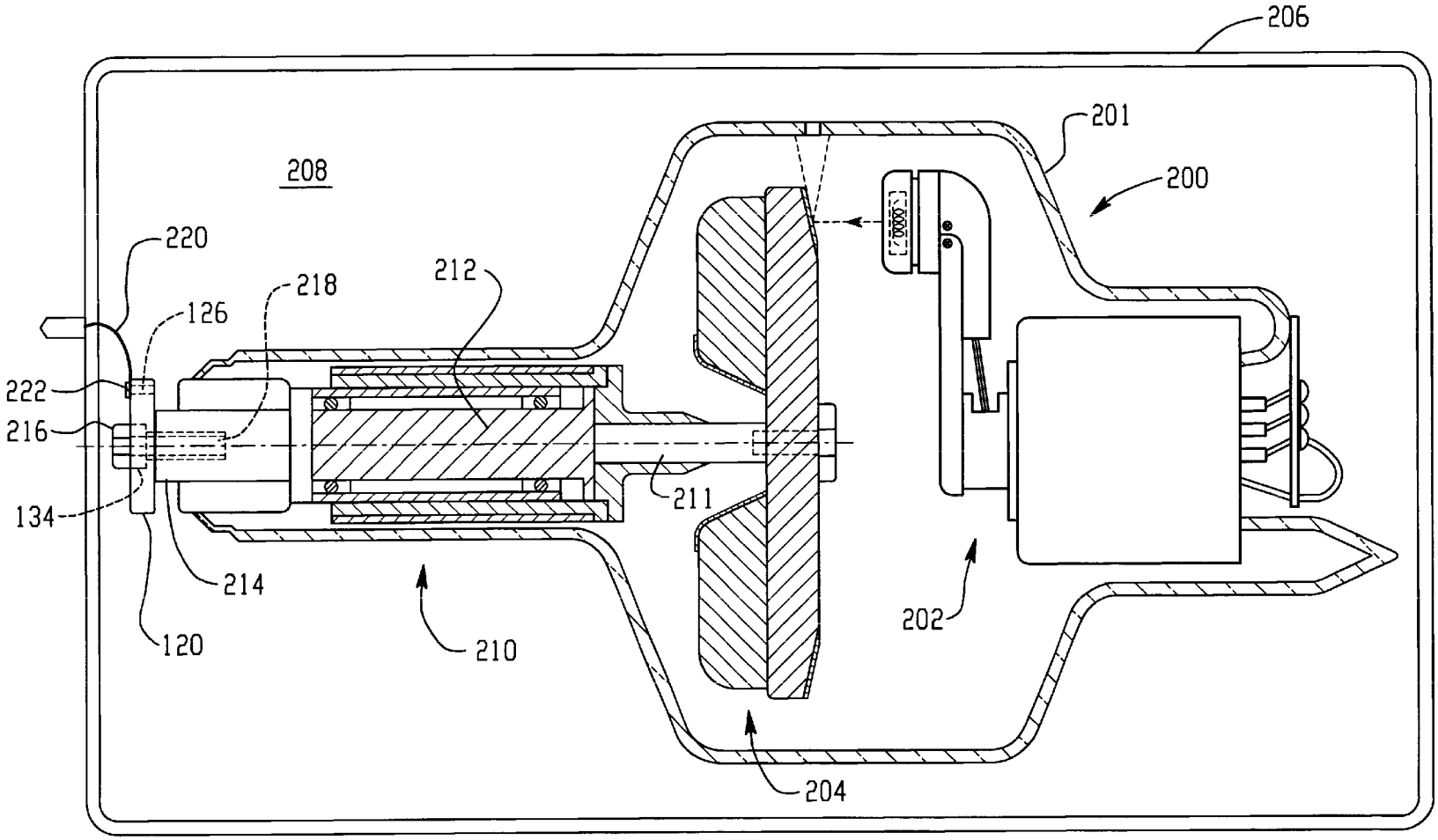
FIG. 9 is a partial sectional schematic representation of a portion of an x-ray tube system showing features of the present invention.

Turning now to FIG. 9, the resistor 120 shown in FIGS. 4–7 is mounted to a rotating anode x-ray tube 200 having an envelope 201, a cathode assembly 202 and an anode assembly 204. The x-ray tube 200 is supported in a housing 206 which defines a chamber 208 that is filled with a cooling medium as described above. The x-ray tube 200 in FIG. 9 also includes conventional power supply and cooling components such as heat exchangers and pumps (not shown).

The anode assembly 204 is rotatably supported within the envelope 201 by a bearing assembly 210. The bearing assembly 210 includes a stationary bearing shaft 212 made of an electrically and thermally conductive material such as copper. An end 214 of the bearing shaft 212 extends from and is connected to the envelope 201. The resistor 120 is secured and electrically connected to the end 214 of the bearing shaft 212 by a bolt 216 that passes through the bore 134 of the hub 128 into a threaded bore 218. A high voltage anode conductor 220 is attached to the high voltage terminal 126 with a threaded bolt 222.

The high voltage from the power supply (not shown) provides the anode potential through the anode conductor 220 into the high voltage terminal 126. The voltage is then applied through the serpentine resistor element 130 (not shown in FIG. 9, see FIGS. 4, 6, 7 & 8) to the hub 128 and on into the bearing shaft 212. From the bearing shaft 212 the anode potential is applied to the anode assembly 204 in a conventional manner.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

Having described a preferred embodiment of the invention, the following is claimed:

1. A high voltage low inductance resistor comprising:
- a resistor body having a perimeter and a center;
- a first terminal located away from the center of the resistor;
- a serpentine resistance element comprising;
  - a first end;
  - a first resistance segment beginning at the first end and extending in a first direction generally around the perimeter of the body;
  - an apex having an input portion and an output portion, the first resistance segment transitioning into the input portion;
  - a second resistance segment exiting the apex from the output portion in a second direction generally opposite the direction of the first resistance segment, the second resistance segment located adjacent to and spaced apart from the first resistance segment, the pattern of the first and second resistance segments arranged to provide a concentric serpentine pattern in a single plane; and
  - a second end located approximately at the center of the resistor element;
- a conducive ring circumscribing the serpentine resistance element, the ring electrically connected to each of the first terminal and the first end of the serpentine resistance element; and
- a second terminal located at the center of the resistor and electrically connected to the second end of the serpentine resistance element.

2. The resistor of claim 1 wherein the electric current in adjacent resistance segments flows in a generally opposite direction.

3. The resistor of claim 1 wherein the second resistance segment is shorter in length than the first.

4. The resistor of claim 1 including a plurality of additional adjacent concentric spaced apart resistance segments and interconnecting apexes, the plurality of segments and apexes located in a single plane and interconnected between the second resistance segment and the second terminal such that a continuous serpentine resistance element extends from the first terminal to the second terminal at the center of the resistor.

5. The resistor of claim 4 wherein, for a pair of resistance segments, the length of the resistance segment located nearer the center of the resistor is shorter than the length of resistance segment located further from the center of the resistor.

6. The resistor of claim 1 wherein the first and second resistance elements are generally circular.

7. The resistor of claim 1 wherein the resistance element is comprised of titanium alloy.

8. The resistor of claim 7 wherein the titanium alloy is 8-1-1.

9. The resistor of claim 1 wherein the serpentine pattern of the resistance element including the resistance segments and apexes is etched from a plate of material.

10. The resistor of claim 1 wherein the body of the resistor is epoxy which encapsulates the serpentine resistance element, the first and second terminals having exposed surfaces for electrical connections.

11. A resistor comprising;

a resistor body;

a first terminal located near the perimeter of the resistor body;

a corona ring electrically connected to the first terminal;

a serpentine resistance element having a first end and a second end, the first end electrically connected to the corona ring and extending in a plurality of adjacent concentric resistance sections located in a single plane, the adjacent concentric resistance sections interconnected at, each adjacent concentric resistance section carrying electric current in an opposite direction than the current in the next adjacent concentric resistance section; and a second terminal located at the center of the resistor body, the second terminal electrically connected to the second end.

12. The resistor of claim 11 wherein the concentric resistance sections are circular.

13. The resistor of claim 11 wherein the distance between adjacent concentric resistance sections at the perimeter of the resistor body is greater than the distance between adjacent concentric resistance sections near the center of the resistor.

14. The resistor of claim 11 wherein the apexes joining the adjacent concentric resistance sections lie adjacent a radial line extending from the center of the resistor.

15. A low inductance resistor comprising:

a body having a first and second generally parallel spaced apart surfaces;

a first terminal located away from the center of the resistor;

a corona ring electrically connected to the first terminal;

a second terminal located at the center of the resistor;

a serpentine resistor electrically connected to and extending in a single plane between the corona ring and second terminal, the resistor having a plurality of concentric adjacent spaced apart resistance segments connected by apexes, the value of the difference in electrical potential between adjacent apexes near the center of the resistor is less than the value of the difference in electrical potential between adjacent apexes near the perimeter of the resistor.

16. The resistor of claim 15 wherein the current flow in adjacent resistance segments is generally opposite in direction.

17. The resistor of claim 15 wherein the concentric resistance segments are generally circular.

18. The resistor of claim 15 wherein the change in value of the difference in electrical potential between adjacent apexes is non-linear when sequentially comparing the voltage difference between apexes from the resistor perimeter to the voltage difference between apexes near the resistor center.

* * * * *